United States Patent [19]

Ikemoto

[11] Patent Number: 4,565,045

[45] Date of Patent: Jan. 21, 1986

[54] WRAPPING DEVICE

[76] Inventor: Shigeru Ikemoto, 36-banchi Honmaeda-cho, Nakagawa-ku, Japan

[21] Appl. No.: 473,111

[22] Filed: Mar. 7, 1983

[30] Foreign Application Priority Data

Mar. 11, 1982 [JP] Japan ..... 57-38811
Mar. 31, 1982 [JP] Japan ..... 57-54392
Oct. 8, 1982 [JP] Japan ..... 57-177974

[51] Int. Cl.[4] ..... B65B 57/02

[52] U.S. Cl. ..... 53/64; 53/219; 53/390; 53/556; 53/389

[58] Field of Search ..... 53/64, 219, 463, 390, 53/556, 389

[56] References Cited

U.S. PATENT DOCUMENTS 3,067,553 12/1962 Rivman et al. ..... 53/390
3,452,511 7/1969 Hoffler ..... 53/219
4,381,637 5/1983 Ballestrazzi et al. ..... 53/64

*Primary Examiner*—Francis S. Husar
*Assistant Examiner*—Linda McLaughlin
*Attorney, Agent, or Firm*—Steele, Gould & Fried

[57] ABSTRACT

A wrapping device comprises a free wheeling film roll mounted on a frame, a film withdrawal slot to guide the film exterior of the frame, a detector to detect the withdrawn film length, a comparator which produces a locker signal each time when the film withdrawn accords with a predetermined length of the film by means of detector signal from the detector, a locker structure for locking the roll in the film withdrawal direction by means of the locker signal, and a press roller to seal the film about a wrapped goods-laden tray. The film on the roll is prevented from being unnecessarily withdrawn and thus allows and economical use of the film.

4 Claims, 7 Drawing Figures

WRAPPING DEVICE

BACKGROUND OF THE INVENTION (1) Field of the Art

The invention relates to a wrapping device to manually wrap an article with, for example, a plastic wrapping film.

(2) Description of the Prior Art

In a wrapping device, a roll of plastic film is frictionally mounted on a pair of support rollers. The film on the roll is pulled out with the accompanying rotary movement of the rollers when wrapping an article.

One of the support rollers is equipped with, a braking structure to stop the rotary movement of the roller by the braking action when the wrapping operation is finished. However, the above construction is such that if the film is tightly pulled, it is allowed to move in the pulling direction even when the brake is applied. This makes it difficult to wrap the article in the film in tautly stretched condition, and fails to insure a positive wrapping condition.

In addition, the length of the film pulled out is variable and not uniform since it is dependent on the judgement of the operator who wraps the article.

For this reason, the length of the film withdrawn is usually more than required to positively wrap the article, thus wasting an unignorable length of film.

SUMMARY OF THE INVENTION

It is therefore a primary object of the invention to provide a novel wrapping device which eliminates the above-mentioned drawbacks. According to the invention, there is provided a wrapping device comprising a roll of film mounted on support rollers, a film withdrawal slot, a locker structure which locks the film in the film withdrawal direction, a lock releases structure which release the locking condition of the locker structure in compliance with the film withdrawal action, and a heat sealing hot plate which thermally welds the film upon completion of the wrapping operation.

The film is prevented from moving in the withdrawal direction precisely when it is of predetermined length and thus eliminates the waste of the film. At the same time, the device enables the film to be tautly stretched so as to insure a positive wrapping condition.

The above and other objects, features and advantages of the present invention will become apparent from the following description and the appended claims, taken in conjunction with the accompanying drawings which show by way of example preferred embodiments of the present invention and in which like component parts are designated by like reference numerals throughout various figures.

BRIEF DESCRIPTION OF THE DRAWINGS

In the accompanying drawings:

FIGS. 1 through 7 show a first embodiment of the invention wherein;

FIG. 1 is a perspective view of a wrapping device;

FIG. 2 is an enlarged side elevational view of the wrapping device;

FIG. 3 is an enlarged, partial cross sectional view of a locker structure;

FIG. 4 is an enlarged elevational view of a film length determiner structure;

FIG. 5 is a block diagram;

FIG. 6 is an enlarged, partial, side elevational view for the purpose of showing a wrapping operation;

FIG. 7 is a perspective view showing one stage of the wrapping operation.

DESCRIPTION OF PREFERRED EMBODIMENTS

Figure 1:
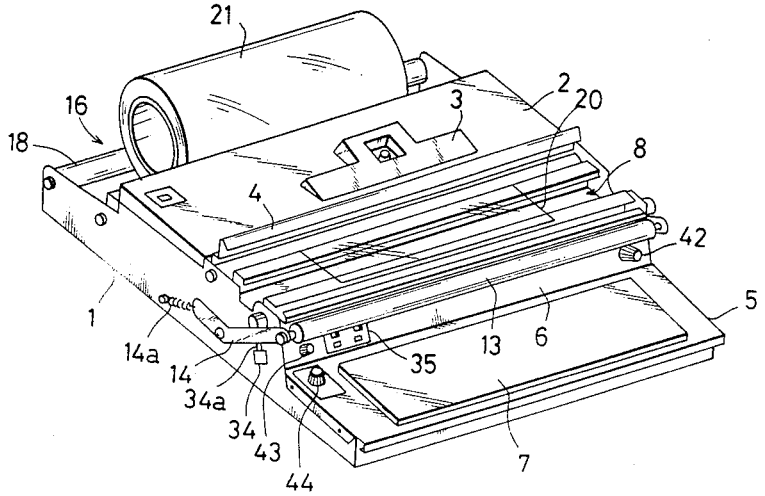

Referring to FIGS. 1 through 7, numeral 1 designates a base frame which carries a top cover 2 at the substantial middle surface. The top cover 2 has a forwardly and rearwardly slidable pedestal 3 at the upper surface, and an inverse-trough shaped extension 4 at the leading end for the purpose of guiding a finger or film as described in detail hereinafter. On the front portion of the base frame 1 is mounted a front panel 5 which has a rising extension 6 above which a heat plate 7 is installed. Between the extensions 4 and 6 is a channel-shaped rocking bar 8 rockably mounted about a pivot shaft **8*a* in the directions of arrow A and opposite to arrow A. The rocking bar 8 has front and rear walls 9, 10 which are spaced from each other. The front wall 9 has a horizontal first holder 9*a* forwardly extended and a guarding panel 9*b* in spaced opposed relationship with the leading end of the holder 9*a*, while the rear wall 10 has a friction free plate 11 at the side substantially opposing to the extension 4, and a L-shaped second holder 10*a* forwardly extended at the top portion, the front end of which vertically depends. Between the rocking bar 8 and the base frame 1 is secured a return spring 12 secured which always biases the bar 8 in the direction of arrow A. In front of the front wall 9 of the rocking bar 8 is mounted a press roller 13 which is attached to the top end of an arm 14 which in turn is pivotably mounted on the base frame 1. Between the arm 14 and the base frame 1 is secured a return spring 14*a* secured which always biases the arm 14 in the direction of the arrow B. Between the first holder 9*a* and the guarding panel 9*b* is a thermal cutter 15 fixedly provided with the base frame 1, so that the cutter 15 positions above the rocking bar 8 when the bar 8** rotates in the direction opposite to arrow A.

Figure 2:
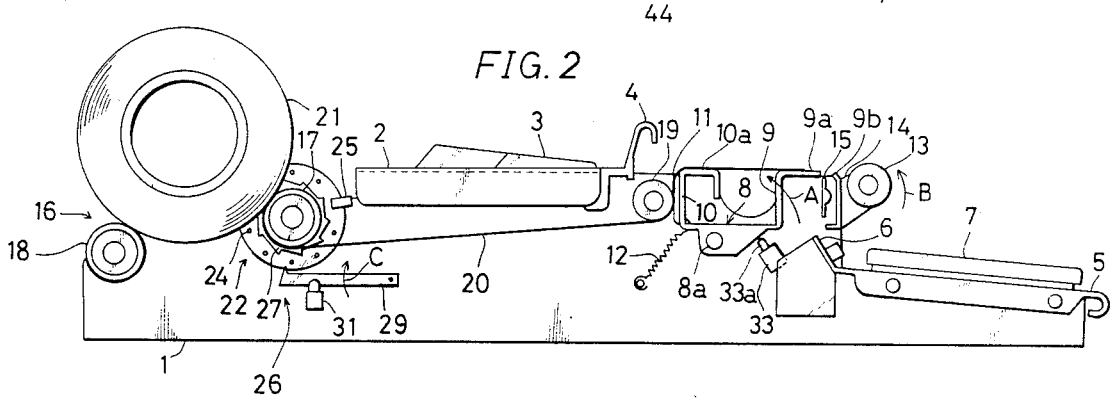

A film supply structure 16 comprising a pair of film support rollers 17, 18 and a film withdrawal roller 19 is best seen in FIGS. 1 and 2. The film support rollers 17, 18 are provided at the rear portion of the base frame 1 in longitudinally spaced relationship, and upon which a roll 21 of plastic film 20 is mounted. The film withdrawal roller 19 is mounted in the base frame 1 to be in registration with the friction free plate 11. In this instance, the plate 11 is abutted with the film withdrawal roller 19 owing to the spring biased movement of the rocking bar 8 in the direction of arrow A. Between the roller 19 and the friction free plate 11 the film 20 is introduced outwardly of the base frame through a film withdrawal port as seen in FIG. 2. In the detector structure 22 seen in FIG. 3, a detector disk 23 is rigidly secured to the support roller 17 which has a circular series of, for example, ten perforations 24 at predetermined circumferential intervals. A proximity switch 25 of photoelectric type comprising, for example, a photocoupler is installed to be in registration with the disk 23. Such is the construction that the switch 25 produces one detector signal, i.e., detector pulse each time one perforation passes the switch 25 in compliance with rotary movement of the disk 23. In this instance, the diameter (d) of the support roller 17 is 32 (mm), so that one detector pulse is equivalent to a withdrawn length of 10 (mm) of the film 20, while one turn of the roller 17 is equivalent to 100 (mm) length of the film 20.

Figure 3:
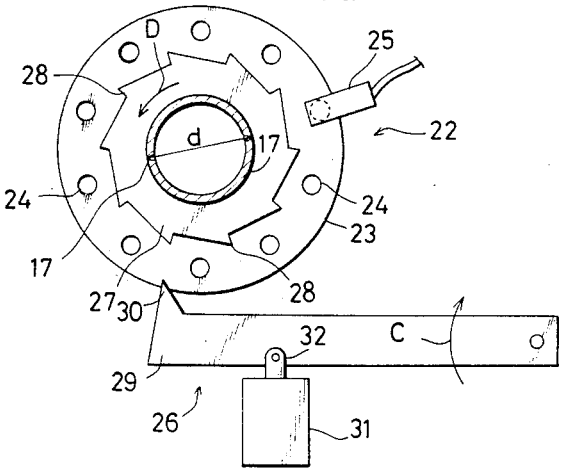
Figure 4:
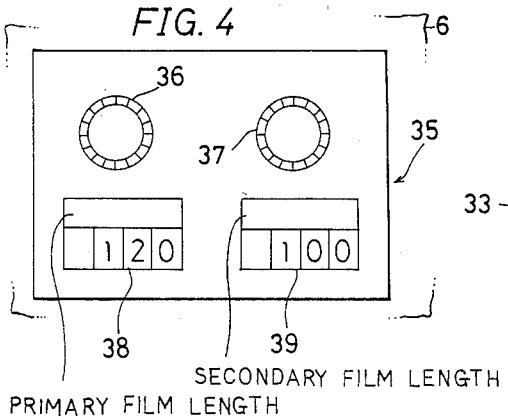
Figure 5:
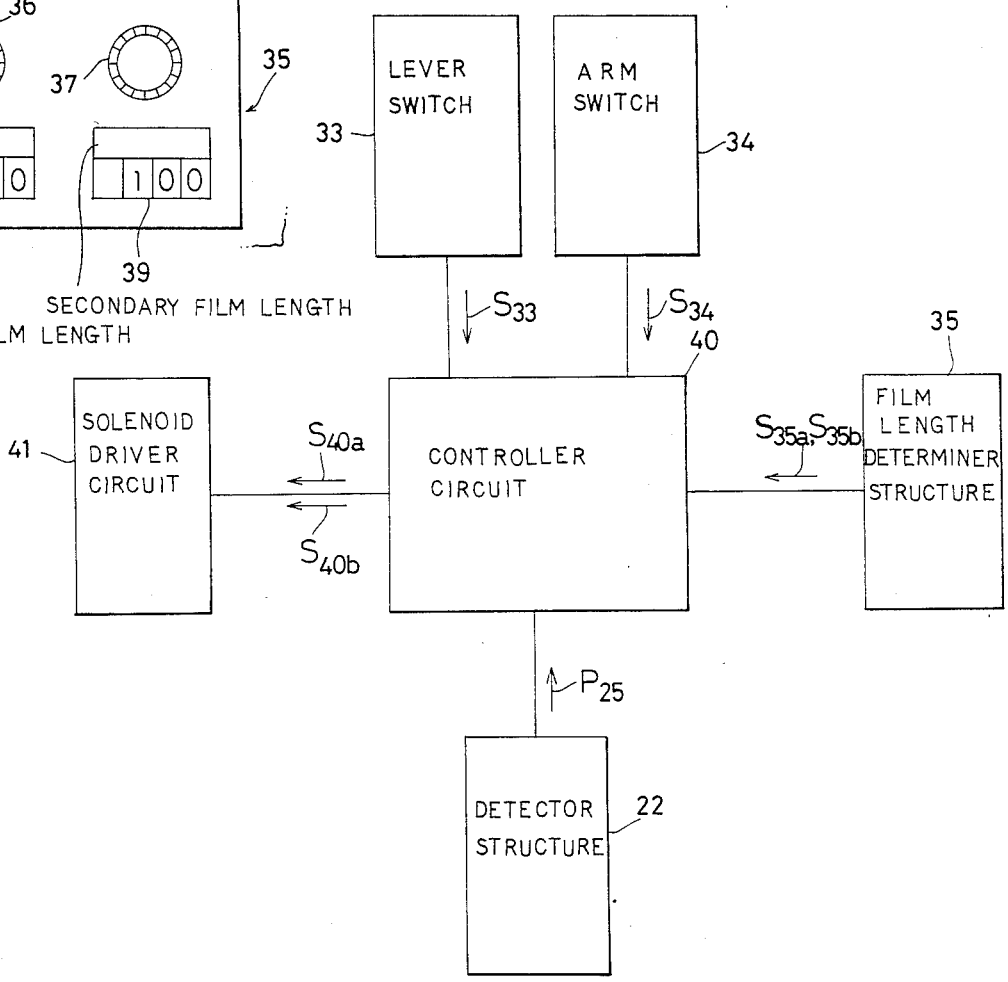

As in detail seen in FIG. 3, a locker structure 26 comprises a ratchet wheel 27, a locker lever 29 and a solenoid 31. The ratchet wheel 27 is fixedly secured to the support roller 17 so that each one tooth 28 of the ratchet wheel 27 positions between the neighboring perforations 24, 24 of the disk 23. The locker lever 29 is pivotably mounted at one end and has a pawl 30 at the other end which engages with the tooth 28 when the lever 29 rotates in the direction of arrow C. The solenoid 31 has a vertically movable plunger 32, the top end of which is connected to the lever 29, so that the plunger 32 moves upwardly from the solid line position of FIG. 3 to rotate the lever 29 in the direction of arrow C when energized.

Reverting to FIG. 2, a lever switch 33 is disposed in registration with the lever or rocking bar 8, so that the lever 8 depresses the actuator 33*a* of the switch 33 when rotated in the direction opposite to arrow A. An arm switch 34 is disposed in registration with the arm 14, so that the arm 14 depresses the actuator 34*a* of the switch 34 when rotated in the direction opposite to arrow B.

As seen in FIGS. 1 through 4, numeral 35 designates a film length determiner structure which has primary and secondary film length indicators 38, 39 which are in turn adjusted by primary and secondary knobs 36, 37. A controller circuit 40 made from a microcomputer, and a solenoid driver circuit 41 are both seen in FIG. 5 and are in detail described hereinafter. Note that numerals 42 through 44 in turn designate a power supply switch, a heat adjustor of the thermal cutter 15.

OPERATION (I) Upon turning on the switch 42, the primary and secondary film withdrawal lengths are determined, for example, 120 (mm) and 100 (mm) respectively by the primary and secondary knobs 36, 37. Determiner signals S35*a*, S35*b* are fed to the controller circuit 40 and in turn stored to first and second memories (not shown).

Figure 6:
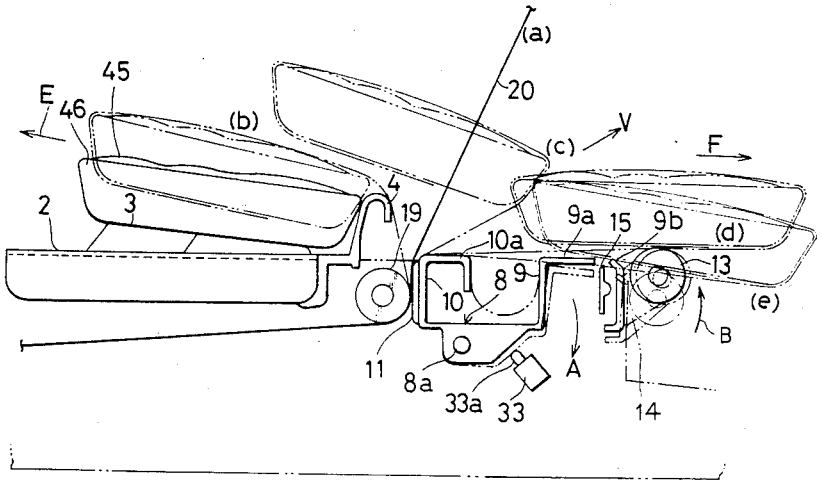

(II) Upon withdrawal of the film 20 as seen at (a) in FIG. 6, the roller 19 rotates with the rotary movement of the rollers 17, 18. With the movement of the roller 17, the disk 23 rotates so that the proximity switch 25 imparts a detector pulse P25 to a first counter circuit (not shown) of the controller circuit 40 each time a perforation 24 passes the switch 25.

When the counted number of the pulse P25 by the first counter circuit accords with the determined value "120 (mm)", i.e., number of pulse counted "12", the controller circuit 40 produces a driver signal S40*a* and imparts it to the solenoid driver circuit 41 so as to energize the solenoid 31. The solenoid 31, thus energized, rotates the locker lever 29 in the direction of arrow C to engage the pawl 30 with the tooth 28 of the ratchet wheel 30. As a result, the support roller 17 is locked in the film withdrawal direction as indicated by arrow D in FIG. 3 (referred to as "primary lock" hereinafter).

(III) In the primary lock condition, the leading end of the film 20 withdrawn is moved toward the pedestal 3 as seen at (b) in FIG. 6 to encircle the underside of a goods-loaded tray 46 placed at the pedestal 3. The tray 46 is further moved in the direction of arrow E to be tightly wrapped in the film 20. In this instance, the film 20 is tautly stretched without unnecessary withdrawal of a length of the film 20, thus attaining a a positively wrapped condition.

(IV) The tray 46 is still further moved from the item (III) position toward the thermal cutter 15 as seen at (c) in FIG. 6, so that the film 20 touches the upper end of the rear wall 10 to rotate the lever 8 in the direction of arrow A. As a result, the lever switch 33 is turned on to impart a release signal S33 to the controller circuit 40. The circuit 40 produces a driver signal S40*a* for the solenoid driver circuit 41 to deenergize the solenoid 31. The solenoid 31, thus deenergized, returns the locker lever 29 to the initial position to release the primary lock, and thus allows the film 20 to move in the film withdrawal direction. Note that when the release signal S33 is fed to the controller circuit 40, the detector pulse P25 from the proximity switch 25 is imparted to a second counter circuit (not shown) of the controller circuit 40.

(V) The furthermore withdrawal of the film 20 from the item (IV) position, rotates the disk 23. With the rotational movement of the disk 23, the detector pulse P25 produced from the proximity switch 25 in a manner similar to that mentioned hereinbefore, is fed to the second counter circuit. When the number of the pulse P25 accords with the determined value "100 (mm)" stored into the second memory, it is, the number of pulse "10", the controller circuit 40 produces a driver signal S40*b* to impart it to the solenoid driver circuit 41. The circuit 41 energizes the solenoid 31 to rotate the locker lever 29 in the direction of arrow C. With the rotational movement of the lever 29, the pawl 30 is brought into engagement with the tooth 28 of the ratchet wheel 27 to lock the support roller 17 (referred to as "secondary lock" hereinafter).

(VI) In the secondary lock condition, as seen at (d) in FIG. 6 the tray 46 is moved in the direction of arrow F with the film 20 tautly stretched. The overlapped portion of the film 20 at the underside of the tray 46, touches the press roller 13. In this instance, the film 20 is thermally severed as seen at (e) in FIG. 6 due to the fact that the thermal cutter 15 positions above the first holder 9*a* of the lever 8 when the lever is rotated in the direction of arrow A.

(VII) The tray 46 is pulled forward with the bottom abutting on the press roller 13 to positively seal the overlapped portion of the film 20. In compliance with the abutting tray 46 against the press roller 13, the arm 14 rotates in the direction opposite to arrow B to turn on the arm switch 34. As a consequence, a lock release signal S34 is fed to the controller circuit 40 to cease the output of a driver signal S40*b* for the solenoid driver circuit 41. The solenoid 31 is deenergized to return the locker lever 29 to the initial position so as to release the secondary lock.

Figure 7:
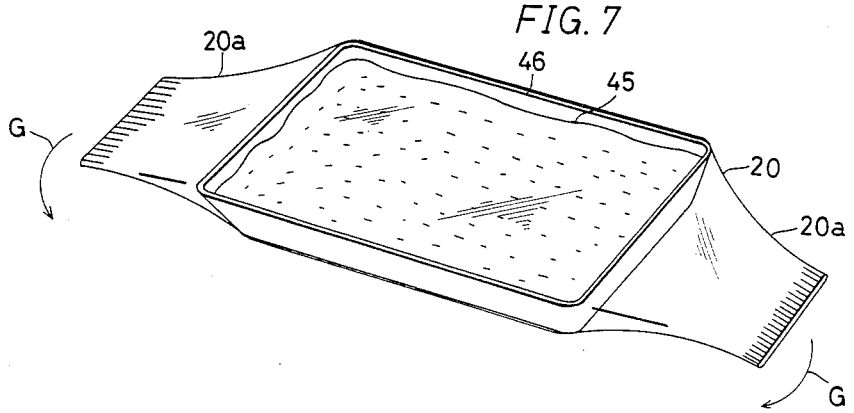

Upon completing the wrapping operation, the lateral marginal wings 20*a* of the film 20 are each turned toward the underside of the tray 46 as indicated by arrow G in FIG. 7. The tray 46 is placed on the heat plate 7 to weld the film 20 residing at the underside of the tray 46.

According to the embodiment of the invention, the following effects are apparently obtained:

(i) The movement in the film withdrawal direction is locked by the locker structure 26. This enables the film 20 to be tautly stretched to tightly wrap an article 45.

(ii) The length of the film 20 withdrawn is detected by the detector structure 22, so that uniform withdrawal length of the film 20 is maintained to avoid the film 20 from being unnecessarily wasted.

One example shows below:

When the tray 46 is 92 (mm) in upper length, 70 (mm) in lower length and 16 (mm) in height, a film length required has conventionally been 288.6 (mm) on average.

According to the invention, however, it is 202.0 (mm), that is, a 30% film length reduction compared to the prior art.

(iii) Such is the construction that the film support roller 17 is locked to positively prevent the roll 21 from over-rotating by the force of inertia. This eliminates a braking structure conventionally required in this type of a wrapping device, and thus alleviates the film withdrawal force, reducing fatigue at the time of wrapping operation.

Conventional construction is such that the braking force is always effective to prevent the roll from over-rotating. Therefore, the film moving in the film withdrawal direction is always subjected to the braking force, and thus requires no smaller film withdrawal force to increase fatigue particularly when there are large number of articles successively being wrapped.

Experimental results show that the conventional film withdrawal force requires 1000~1100(gram), while the force required to operate the device of the present application is not more than 350(gram), that is, 34% reduction compared to the prior art, according to the invention.

In modifications, it is noted that the detector structure may be of magnetic type proximity switch, instead of photoelectric type, and the controller circuit may be completely made from a microcomputer, the signal of which may be analogue, instead of digital through the embodiments of the invention.

What is claimed is:

1. A wrapping device comprising (a) a frame having a pair of rollers for rotatably supporting a film roll and a spaced film withdrawal roller rotatably carried therein for withdrawing film from the roll;

(b) a top cover member forming the top surface of said frame and on which a product can be partially wrapped with film as the film is withdrawn from the film roll;

(c) an elongated rocking bar rockably mounted on said frame, a portion of said rocking bar being biased by the film to press against the film withdrawal roller with the film sandwiched therebetween, the rocking bar being pivoted by the film from an initial position to a switch activating position;

(d) a press roller pivotally mounted on the frame in position to receive the partially wrapped product, the press roller being pivotally moved upon contact by the product;

(e) a means operatively connected to one of said pair of rollers for detecting the length of withdrawn film and to produce a detector signal in accordance therewith;

(f) a control circuit means operatively connected to said means for detecting the length of withdrawn film for receiving the detector signal and comparing it with a predetermined value, said control circuit means being adapted to produce a primary or secondary lock signal when the detector signal corresponds with the predetermined value, said control circuit means being further adapted to compare the detector signal with the secondary predetermined value after comparing the detector signal with the primary predetermined value and producing the primary lock signal;

(g) a locking means operatively connected to said roller of said pair of rollers for receiving said primary or secondary lock signal to lock one of said rollers to prevent the film from being further withdrawn;

(h) a first lever switch adjacent to and actuated by the rocking bar when the rocking bar is pivoted to its said switch activating position, the first lever switch being actuated to release the locking means from the influence of the primary lock signal; and (i) a second lever switch adjacent to and actuated by said press roller when the press roller is pivotally moved by the product, the second lever switch being actuated to release the locking means from the influence of the secondary lock signal.

2. A wrapping device as set forth in claim 1, wherein the means for detecting is adapted to detect the number of rotations of a disc mounted on said roller of said pair of rollers rotated by means of frictional contact with running film and to produce said detector signal.

3. A wrapping device as set forth in claim 1 wherein the locking means comprises said roller being rotated through frictional contact with the running film and a means adjacent to said locking means which is electromagnetically actuated by said lock signal to constrain rotation of said roller.

4. A wrapping device according to claim 1 wherein the means for detecting comprises said control circuit means to compare a first length of withdrawn film with a first predetermined film length and a second length of withdrawn film with a second predetermined film length.

* * * * *